US010895178B2

(12) United States Patent
Wells et al.

(10) Patent No.: US 10,895,178 B2
(45) Date of Patent: Jan. 19, 2021

(54) ACTUATOR FOR CAM PHASER AND CAM PHASER

(71) Applicant: ECO Holding 1 GmbH, Marktheidenfeld (DE)

(72) Inventors: Tim Wells, Sterling Heights, MI (US); Brian Kujawski, Whitehall, MI (US); Brent Brower, Muskegon, MI (US)

(73) Assignee: ECO Holding 1 GmbH, Marktheidenfeld (DE)

( * ) Notice: Subject to any disclaimer, the term of this patent is extended or adjusted under 35 U.S.C. 154(b) by 16 days.

(21) Appl. No.: 15/892,812

(22) Filed: Feb. 9, 2018

(65) Prior Publication Data

US 2018/0258801 A1 Sep. 13, 2018

Related U.S. Application Data

(60) Provisional application No. 62/468,581, filed on Mar. 8, 2017.

(51) Int. Cl.
*F01L 1/344* (2006.01)
*F01L 1/46* (2006.01)

(52) U.S. Cl.
CPC ..... *F01L 1/3442* (2013.01); *F01L 1/344* (2013.01); *F01L 1/46* (2013.01); *F01L 2001/3443* (2013.01); *F01L 2001/3445* (2013.01); *F01L 2001/34426* (2013.01); *F01L 2001/34433* (2013.01)

(58) Field of Classification Search
CPC ..... F01L 1/3442; F01L 2001/34433; F01L 2001/34426; F01L 2001/3443; F01L 2001/3445; F01L 1/34; F01L 1/46; F01L 2103/00
USPC ..... 123/90.17, 90.15; 464/160
See application file for complete search history.

(56) References Cited

U.S. PATENT DOCUMENTS

2005/0072391 A1* 4/2005 Green ..... F01L 1/022 123/143 C
2006/0207538 A1* 9/2006 Lancefield ..... F01L 1/022 123/90.17
2012/0312262 A1* 12/2012 Hoppe ..... F01L 1/3442 123/90.17

(Continued)

FOREIGN PATENT DOCUMENTS

DE 102009020652 A1 * 11/2010 ..... F01L 1/3442
DE 102009020652 A1 11/2010

(Continued)

OTHER PUBLICATIONS

DE-102009020652 english langauge machine translation, Date:Oct. 2010, (Year: 2010).*

*Primary Examiner* — Patrick Hamo
*Assistant Examiner* — Wesley G Harris
(74) *Attorney, Agent, or Firm* — Von Rohrscheidt Patents

(57) ABSTRACT

An actuator for a cam phaser, wherein the cam phaser includes a hydraulic valve that is adjustable by the actuator, wherein the actuator is receivable at a housing section by at least one form locking connection, wherein the at least one form locking connection includes a first form element pair and a second form element pair, wherein the first form element pair includes a first stop and the second form element pair includes a second stop, and wherein the first stop and the second stop are oriented in opposite directions of rotation of the actuator.

12 Claims, 3 Drawing Sheets

(56) References Cited

U.S. PATENT DOCUMENTS

| | | | | |
|---|---|---|---|---|
| 2013/0055975 | A1* | 3/2013 | Bosel | F01L 1/3442 123/90.15 |
| 2013/0234816 | A1* | 9/2013 | Grunschlag | H01F 7/126 335/278 |
| 2013/0312684 | A1* | 11/2013 | Boesel | F01L 1/344 123/90.17 |
| 2015/0075464 | A1 | 3/2015 | Taylor et al. | |
| 2016/0032791 | A1 | 2/2016 | Cecil et al. | |
| 2017/0002700 | A1 | 1/2017 | Bender et al. | |

FOREIGN PATENT DOCUMENTS

| | | | | |
|---|---|---|---|---|
| DE | 102010012917 | A1 | 4/2011 | |
| DE | 102010008931 | A1 * | 8/2011 | F01L 1/3442 |
| JP | 6015605 | B2 | 10/2016 | |
| WO | WO2017084662 | A1 | 5/2017 | |

* cited by examiner

ACTUATOR FOR CAM PHASER AND CAM PHASER

RELATED APPLICATIONS

This application claims priority from and incorporates by reference U.S. provisional patent application 62/468,581 filed on Mar. 8, 2017.

FIELD OF THE INVENTION

The invention relates to an actuator for a cam phaser and a cam phaser.

BACKGROUND OF THE INVENTION

Cam phasers for internal combustion engines are well known in the art. The cam phaser includes a hydraulic valve with a piston that is axially movable in a housing of the hydraulic valve and that is configured to control a hydraulic loading of the cam phaser. The cam phaser is controlled hydraulically through a positioning of the piston and a corresponding opening or closing of connections at the housing. The piston is positioned by an electromagnetic actuator.

In order to attach the actuator attachments with and without bolts are known in the art.

Thus, the publication document US 2013/0234816 discloses a connection of the actuator with a housing section wherein metal spring elements are used to provide the connection wherein the metal spring elements can change their interlocking position due to vibrations of the internal combustion engine. In case a change of the interlocking position with a corresponding disengagement of the clamping of the spring elements occurs this can cause a disengagement of the rotational connection since no rotation in any direction is restricted.

BRIEF SUMMARY OF THE INVENTION

Thus, it is an object of the instant invention to provide an actuator for a cam phaser which attachable in a manner that is secure for operations. It is another object of the invention to provide a cam phaser that is configured to implement a reliable adjustment of the cam shaft.

The object is achieved by an actuator for a cam phaser, wherein the cam phaser includes a hydraulic valve that is adjustable by the actuator, wherein the actuator is receivable at a housing section by at least one form locking connection, wherein the at least one form locking connection includes a first form element pair and a second form element pair, wherein the first form element pair includes a first stop and the second form element pair includes a second stop, and wherein the first stop and the second stop are oriented in opposite directions of rotation of the actuator.

The object is also achieved by a cam phaser with the features described supra. Advantageous embodiments with useful and non-trivial improvements according to the invention are stated in the respective dependent claims.

An actuator according to the invention for a cam phaser is configured receivable at a housing section through at least one form locking connection wherein the housing section can be a component or a component section of an internal combustion engine or of the cam phaser itself.

The cam phaser includes a hydraulic valve which is configured adjustable by the cam phaser. According to the invention the connection includes a first form element pair and a second form element pair wherein the first form element pair includes a first stop and the second form element pair includes a second stop, wherein the stops are configured oriented in an opposite direction of rotation of the actuator. This means put differently that for a first direction of rotation which is for example oriented clock wise the first form element pair is disengageable and for a second direction of rotation that is opposite to the first direction of rotation, thus counter clockwise, the second form element pair is disengage able. Thus, a secured connection is implemented since operations of the internal combustion engine generate vibrations which are prone to disengage in particular rotary connections. However, since the operationally secure connection includes two form element pairs that are oriented opposite to each other the connection between the actuator and the housing section cannot be disengaged by a rotation.

Advantageously the first form element pair is configured different from the second form element pair.

In one embodiment of the actuator according to the invention it is configured to be actuatable to engage the connection or to disengage the connection with a linear movement or with a rotating movement. It is an advantage that a linear movement in particular an axial movement along a longitudinal axis of the actuator and a rotating movement, put differently a rotary movement, are required. This means that two totally different movements are required which do not occur with this precise combination during operations of the internal combustion engine so that the connection could be disengaged or loosened during operations. In particular the actuator is advantageously configured actuatable to disengage the connection through the initial translatoric movement and the subsequent rotating movement.

In another embodiment the first form element pair is configured as a bayonet closure and the second form element pair is configured as a snap lock connection.

If the first form element pair is configured completely rigid and the second form element pair is configured at least partially elastic, in particular a non-destructive solution can be implemented since an element of the second form element pair is configured elastic with respect to its size and/or with respect to its positioning. Thus, e.g. for disengaging the second form element pair the elastic element can be compressed so that its interlocked position can change.

In an advantageous embodiment of the actuator according to the invention the elastic element of the second form element pair is configured movable at least in axial direction relative to a support element of the actuator or relative to its longitudinal axis. This means that e.g. by lifting the elastically configured element, or in case the elastically configured element is preloaded before assembly, it can be taken out of its interlocked position by depressing the elastic element which disengages the second form element pair.

In another advantageous embodiment of the actuator includes an assembly handle. The assembly handle facilitates a simplified assembly since the actuator is essentially configured as a component that is circular at its circumference. When gripping and rotating the actuator the assembly tool can slip off or if the actuator is mounted manually a hand can slip off. This is prevented by the mounting handle.

In a particularly assembly friendly and slip resistant manner the assembly handle is configured as a bar that extends transversally over a support body of the actuator. Thus, the assembly handle is provided as a wing nut. Thus, put differently, the actuator can be gripped from above, this means put differently at a surface that is oriented away from the housing section wherein a view at least onto the form element portions configured at the housing section is unobstructed. Furthermore a torque about the longitudinal axis of the actuator can be provided at the bar by pressing onto the bar in a simple manner.

In case the mounting handle is configured perpendicular to a connection socket of the actuator the mounting can be advantageously used as a support for an inner hand surface during manual assembly.

In another advantageous embodiment the mounting handle is configured gap free together with the support element which prevents the mounting handle from breaking off in particular when large forces would be required for generating the mounting or dismounting torque.

The actuator is produced from plastic material in a cost effective manner by a plastic injection molding method. The advantage of the plastic injection molding method is that components of the actuator like e.g. the pole tube etc. are firmly received during the method. Furthermore the form element pairs configured at the actuator and the mounting handle can also be formed through the injection molding method integrally in one piece thus without assembly together with the housing of the actuator.

A second aspect of the invention relates to a cam phaser with an electromagnetic actuator. Thus, a reliably operating cam phaser can be implemented which facilitates a functionally reliable adjustment of valve timing of an internal combustion engine which includes the cam phaser according to the invention. Since adjusting the valve timing influences a fuel burn and accordingly also emissions of the internal combustion engine an internal combustion engine can be implemented that has reduced fuel burn and emissions and that operates reliably.

BRIEF DESCRIPTION OF THE DRAWINGS

Further advantages, features and details of the invention can be derived from the subsequent description of advantageous embodiments and from the drawing figure. The features and feature combinations recited supra and the features and feature combinations illustrated in the subsequent figure description and/or in the figure are not only usable in the respectively stated combination but also in other combinations or by themselves without departing from the spirit and scope of the invention. Identical reference numerals are associated with identical or functionally equivalent elements. For reasons of clarity it is possible that the elements are not designated with their respective reference numerals in all drawing figures without losing their association, wherein.

DETAILED DESCRIPTION OF THE INVENTION

Figure 1:
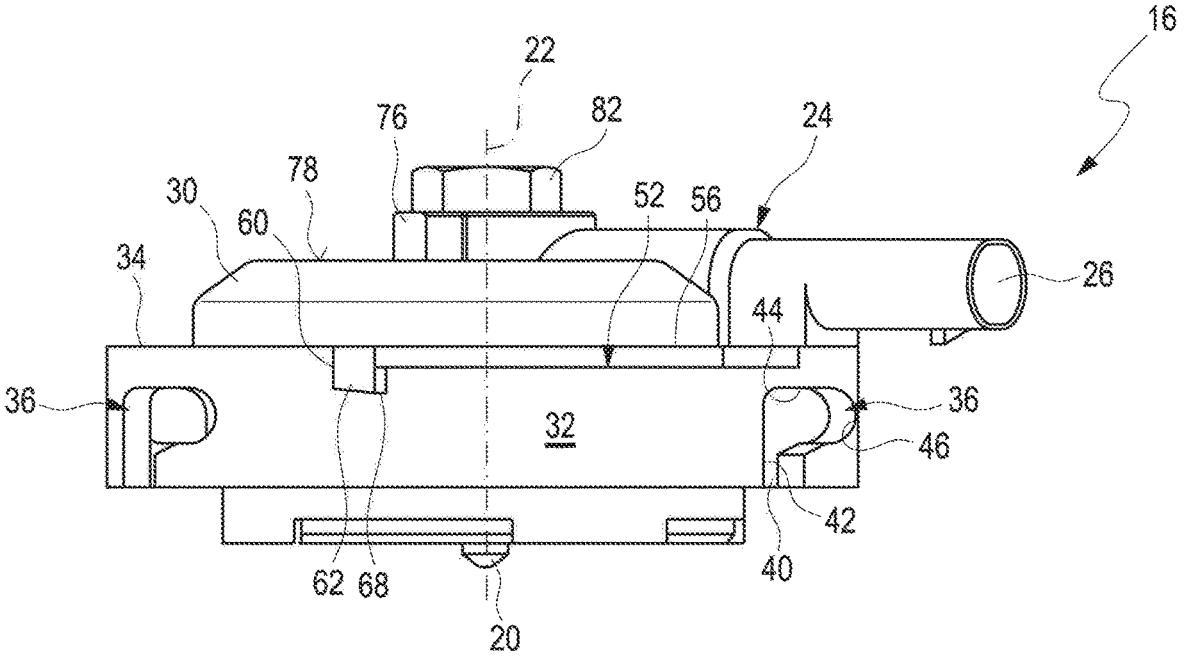
FIG. 1 illustrates a side view of an actuator for a cam phaser according to the invention.
Figure 2:
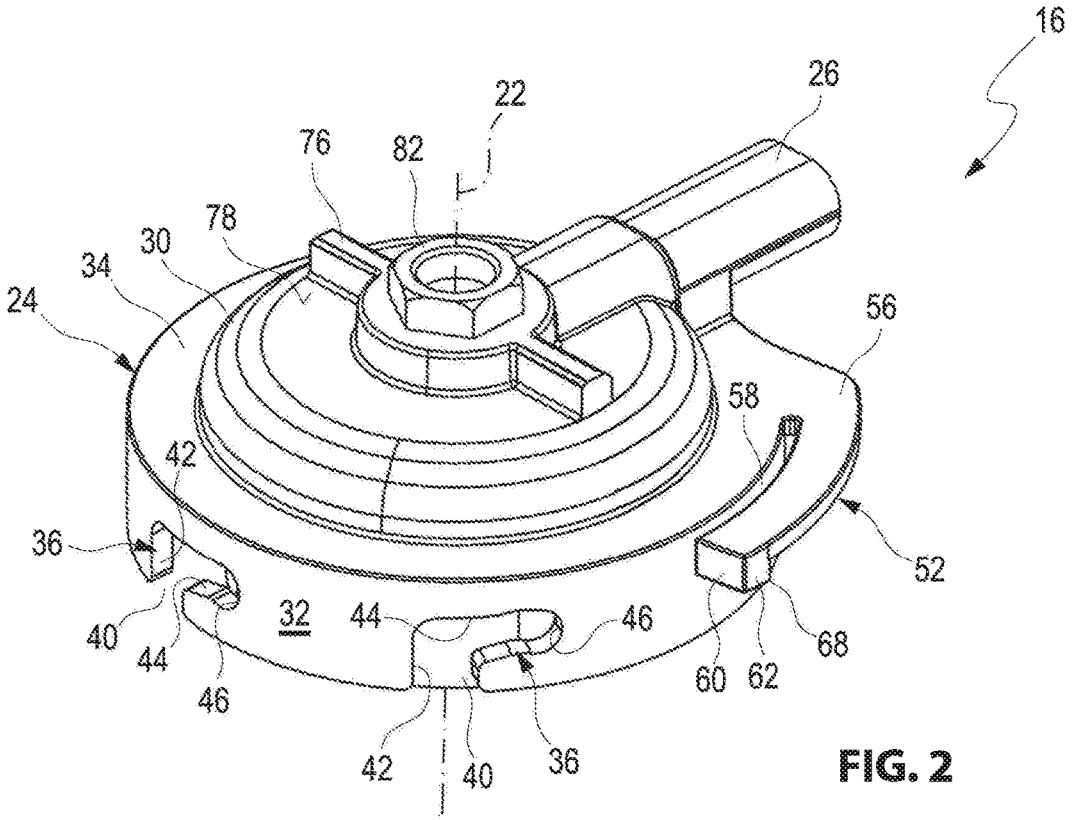
FIG. 2 illustrates a perspective view of the actuator according to FIG. 1.
Figure 3:
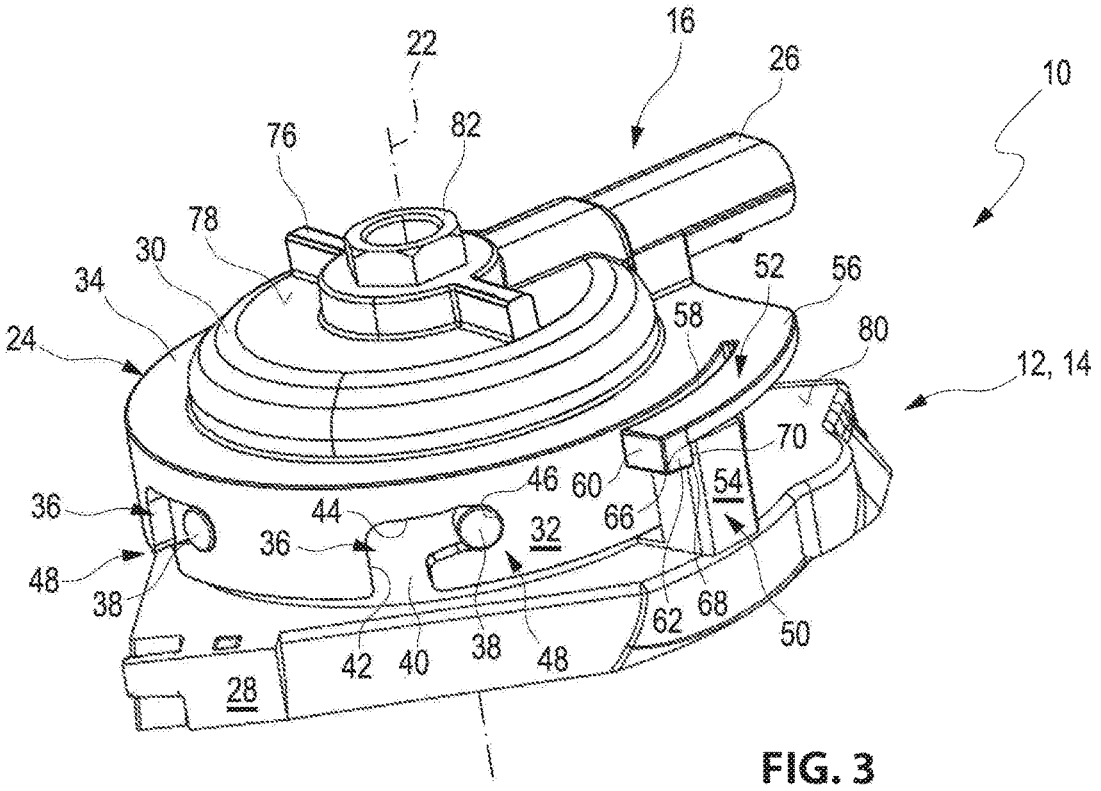
FIG. 3 illustrates a perspective view of the actuator according to FIG. 1 in an assembled condition at a housing section.
Figure 4:
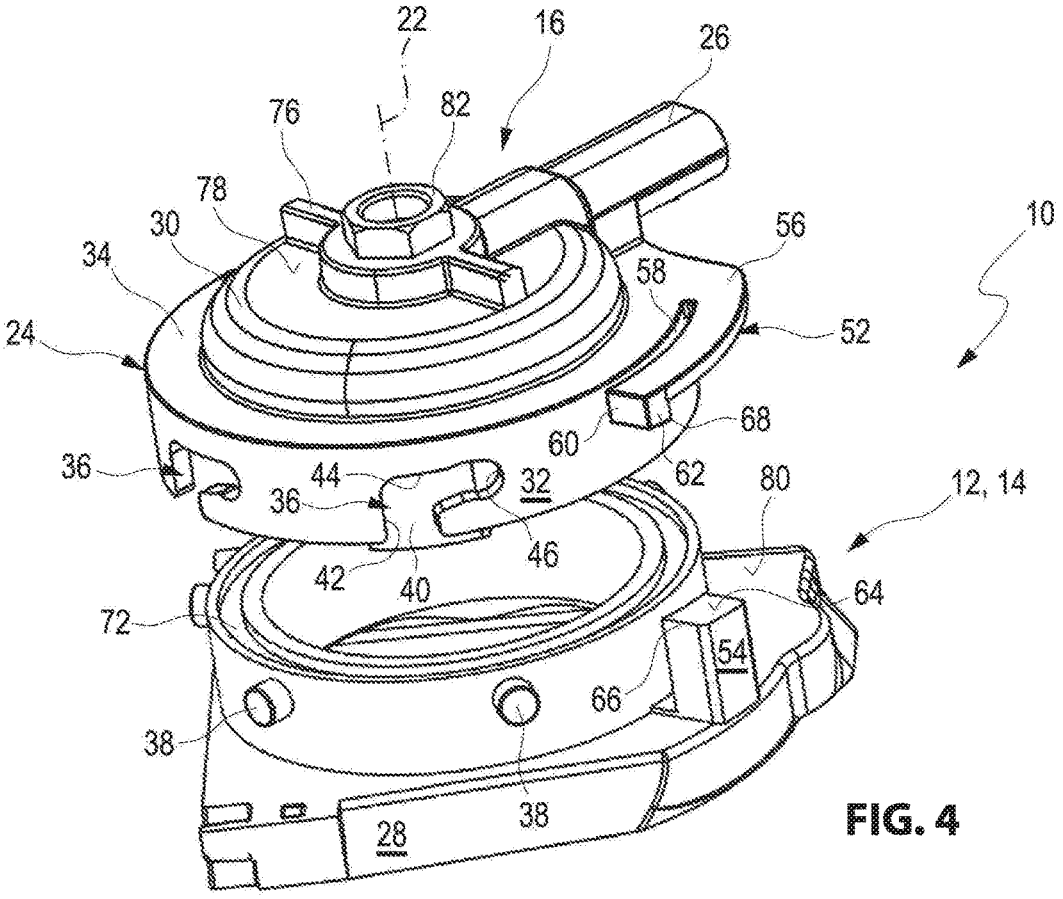
FIG. 4 illustrates a perspective view of the actuator according to FIG. 1 and the housing section before assembly.

A cam phaser 10 according to the invention is configured for adjusting a cam shaft. The cam phaser 10 includes a hydraulic valve that is not illustrated in more detail which includes a piston that is not illustrated in more detail and movable in particular, axially movable. In order to hydraulically supply the cam phaser 10 plural connections are provided at a housing of the hydraulic valve that receives the piston. The housing is provided substantially tubular.

During operations of an internal combustion engine 14 including a cylinder head 12 the cam phase 10 facilitates providing opening and closing times of gas control valves of the internal combustion engine 14. Thus, the cam phaser 10 adjusts an angular orientation of a cam shaft of the internal combustion engine 14 that is not illustrated in more detail and received in the cylinder head 12 relative to a crank shaft of the internal combustion engine 14 that is in not illustrated in more detail in a continuously variable manner, so that the cam shaft is rotated relative to the crank shaft. The relative rotation of the cam shaft adjusts the opening and closing timing of the gas control valves so that the internal combustion engine 14 can develop optimum power at a respective speed.

A stator of the cam phaser 10 that is not illustrated in more detail is connected torque proof with a drive gear of the cam shaft that is not illustrated in more detail. Insides of the stator base element include radially inward extending bars arranged at uniform internals so that an intermediary space is formed between two respectively adjacent bars. A blade that is not illustrated in more detail of a rotor hub that is not illustrated in more detail of a rotor that is not illustrated in more detail of the cam phaser 10 protrudes into the intermediary space. Corresponding to the number of the intermediary spaces the rotor hub includes a number of blades. Thus, the blades facilitate dividing each intermediary space in two pressure cavities. A pressure medium, typically hydraulic fluid, is introduced into the intermediary spaces by the hydraulic valve.

A pressure cavity is associated with each operating connection. Thus a first pressure cavity is associated with the first operating connection and a second pressure cavity is associated with the second pressure connection. In order to adjust an angular orientation between the cam shaft and the crank shaft the pressure medium in the first pressure cavity or in the second pressure cavity is pressurized while the second pressure cavity or the first pressure cavity is unloaded. The unloading is performed through at least one tank connection wherein the hydraulic fluid can drain through the tank connection.

The piston is moved by the actuator 16 wherein a movable plunger 20 of the actuator 16 is axially movable along a longitudinal axis of the actuator 16. The actuator 16 is configured as an electromagnetic actuator.

The actuator 16 includes a pole tube that is not illustrated in more detail and that is arranged within a coil that is configured cylindrical and generates a magnetic field and a housing 24. The housing 24 is produced by plastic injection molding method so that the housing 24 can be produced in a cost effective manner and so that various components of a pole yoke can be inserted during the injection molding method so that they provide a closed magnetic flux. In order to provide the magnetic flux the coil is loadable with an electric current through a connection socket 26 that is received in the housing 24.

The actuator 16 is configured as a preassembled unit to be attached at a housing section 28. In the illustrated embodiments the housing section 28 forms a portion of the cylinder head 12. This means put differently that the actuator 16 is attached at the cylinder head 12. By the same token the housing section 28 can also be a portion of the cam phaser 10 or another component of the internal combustion engine 14.

In order to provide a safe connection of the actuator 16 with the housing section 28 the housing 24 includes a groove ring 32 at a carrier element 30 wherein the groove ring includes the operating components, pole tube, pole yoke, coil, plunger etc. of the actuator 16 wherein the groove ring is attached at the carrier element 30 by an annular disc 34 at a radial distance.

The groove ring 32 includes L shaped grooves 36 that are symmetrically distributed over its circumference. By the same token the grooves 36 can also be arranged asymmetrically distributed. The grooves 36 are configured to receive arresting elements 38 that are arranged at the housing section 28. In order to produce the reliable connection of the actuator 16 with the housing section 28 the actuator 16 is positioned with its grooves 36 at their inlet openings 40 above the arresting elements 38. Thereafter the arresting elements 38 are received in the correspondingly arranged grooves 36 by an axial movement of the actuator 16 in a direction towards the housing section 28. If the arresting elements 38 are sufficiently received in axial sections of the grooves 36 a rotating movement is performed in clock wise direction of the actuator 16 about its longitudinal axis 22 wherein the arresting elements 38 are supported in radial sections 44 of the grooves 36. Groove ends 46 of the grooves 36 provide a stop for the arresting elements 38 at the groove ring 32 and characterize a completion of the clock wise rotation that provides the attachment. The grooves 36 and the arresting elements 38 in combination this means put differently a groove 36 and an arresting element 38 form a first form element pair 48. Thus, the reliable connection includes a first form element pair 48 wherein an element of the first form element pair 48 is configured at the actuator 16 and another element of the first form element pair 48 is arranged at the housing section 28. The first form element pair 48 in this embodiment is configured as a so called bayonet closure.

The arresting elements 38 are configured as cylindrical pins wherein their circular contour facilitates a rotation of the actuator 16 without wedging.

In this context it is appreciated that the direction of rotation providing attachment is certainly a function of the arrangement of the radial section 44. In the illustrated embodiment the radial sections 44 of the grooves 36 are configured adjacent to the axial sections 42 so that the axial attachment of the actuator 16 at the housing section 28 requires a clockwise rotation after the axial movement.

In order to implement the operationally reliable connection a second form element pair 50 is provided. The second form element pair 50 which is configured as a snap lock connection includes an elastic arm 52 arranged at the actuator 16, in particular at the annular disc 34 and a stop element 54 arranged at the housing section 28. In order to provide the snap locked connection the arm 52 is configured interlockable at the stop element 54, wherein the arm is configured hook shaped in this embodiment.

The arm 52 is firmly connected at its first end 56 with the annular disc 34, thus with the actuator 14, and extends in a circumferential portion of the actuator 14 along the groove ring 32 wherein a movement gap 58 is formed between the groove ring 32 and the gap 52.

At a second end 60 that is oriented away from the first end 56 the arm 52 is configured hook shaped by an interlocking element 62. The interlocking element 62 provides interlocking at the stop element 54.

In order to attach the actuator 16 that the housing section 28 the interlocking element 62 contacts a surface 64 of the stop element 54 which surface is oriented towards the arm 52 during an axial movement of the actuator 16 in a direction towards the housing section 28 wherein the movement also positions the arresting elements 38 in the entry openings 40 and during the rotation the interlocking element is moved over the surface 64 sliding towards an interlocking edge 66 of the stop element 54, a first interlocking edge 66 of the second form element pair 50. When the groove ends 46 are reached by the arresting elements 38 the first interlocking edge 66 is passed over by the second interlocking edge 68 of the second form element pair 50 which is arranged at the interlocking element 62 oriented towards the stop element 54. Since the first interlocking edge 66 is passed over by the second interlocking edge 68 and the arm 52 is configured elastic the interlocking element 62 performs an axial movement in a direction towards the housing section 28 wherein the second interlocking edge 68 is positioned below, put differently in a direction of the housing section 28 offset from the first interlocking edge 66 when the rotation is completed. Thus, an interlocking of the second form element pair 50 is producible directly by an interlocking of the first form element pair 48.

A disengagement of the reliable connection can only be provided by an axial dislocation of the interlocking element 62 in the first disengagement step since a counter clockwise rotation that is necessary for this embodiment for disengaging the connection makes the interlocking element 62 contact the stop element 54. Disengaging the second form element pair 50 can only be provided by a clockwise rotation or by axial lifting of the interlocking element 62. However, since a clockwise rotation blocks the first form element pair 48, disengaging the second form element pair 50 can be provided solely by the axial lifting of the interlocking element 62. Thus, the interlocking element 62 has to be moved away from the housing section 28 in order to disengage the connection This means put differently that the connection includes the first form element pair 48 and the second form element pair 50 wherein the first form element pair 48 is configured different from the second form element pair 50 and wherein the first form element pair includes a first stop configured as the arresting element 38 and the second form element pair 50 includes a second stop configured as the first interlocking edge 66 oriented towards the interlocking element 62 and wherein at least one of the two stops blocks as a function of the direction of rotation of the actuator 16. This means put differently that in assembled condition a pure rotation of the actuator 16 independently from its direction causes one of the two stops to block as a matter of principle. This means that the stops 38, 66 are configured oriented in an opposite directions of rotation of the actuator 16.

The axial lifting of the interlocking element 62 can be performed by a tool or alone by a finger. Thus, in order to establish the connection or to disengage the connection of the actuator 16 with the housing section 28 the connection is configured to be provided by initially performing the translatoric or axial movement and thereafter performing the rotary movement.

In order to provide a particularly secure connection an overhang 70 provided in the assembled condition has to be selected between the first interlocking edge 66 and the second interlocking edge 68 as a function of the elasticity of the arm 52. This means put differently if the arm 52 is hardly movable and its elasticity is low a small overhang 70 suffices, however, if the elasticity of the arm 52 is large this means it moves easily and starts to vibrate easily the overhang 70 is to be selected large. In the illustrated embodiment the arm 52 is configured movable in a direction of the longitudinal axis 22, thus axially move able.

Figure 5:
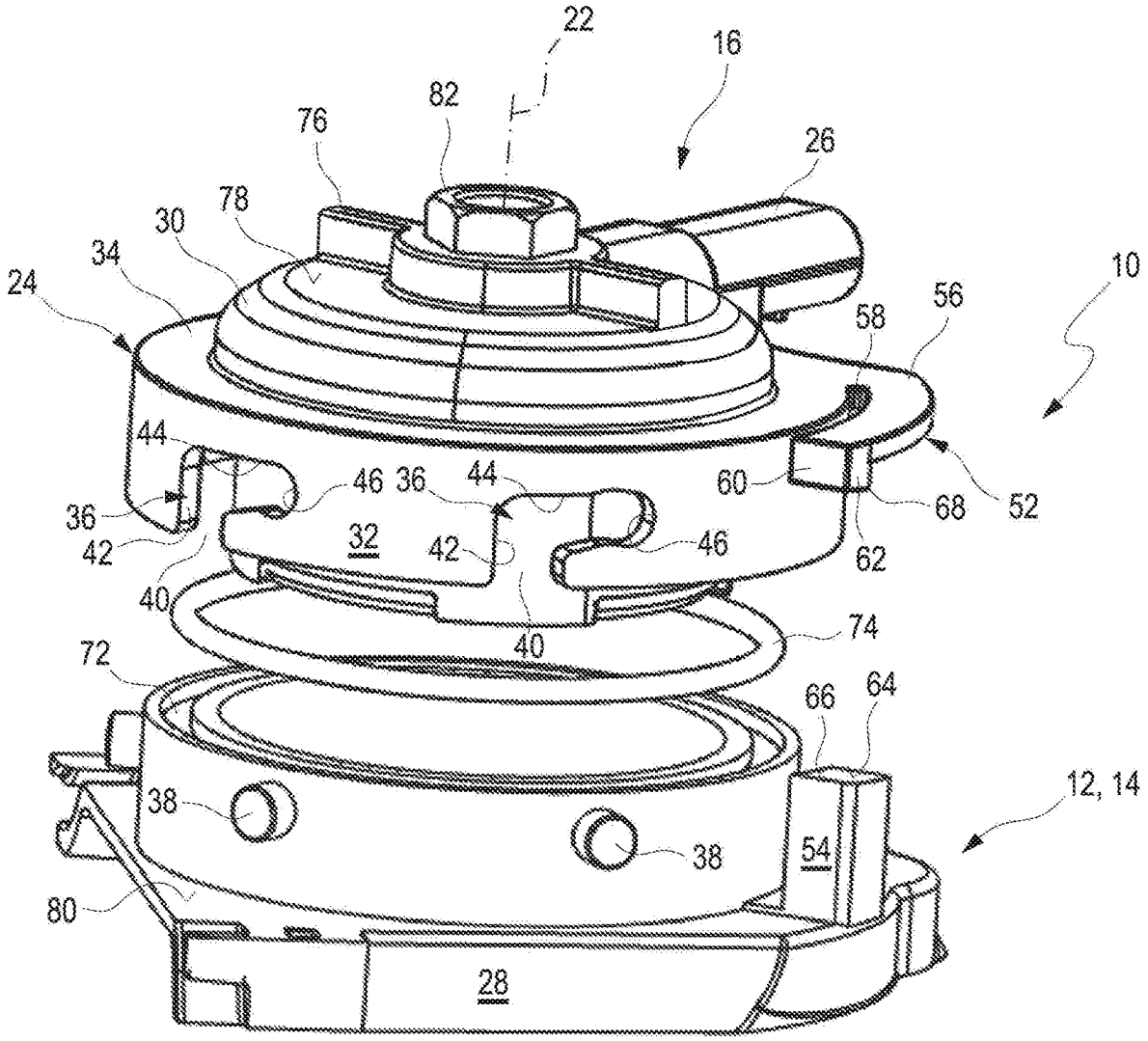
FIG. 5 illustrates a perspective view of the actuator in another embodiment and the housing section before assembly.

The cam phaser 10 according to the invention is illustrated in FIG. 5 in a perspective exploded view. The housing section 28 includes a ring groove 72 which is provided to receive a seal element 74 which is configured in this embodiment as an O-ring.

In order to be able to grip the actuator 16 during assembly without a risk of slipping the actuator includes an assembly handle 76 which extends in a transversal direction over the carrier element 30 at its cover surface 78 and which is configured as a bar. The cover surface 78 of the carrier element extends essentially parallel to a housing section surface 80.

The mounting handle 76 could also extend partially or completely from the cover surface 78 at a circumference of the housing 24. However, it is essential that the assembly handle 76 extends over the cover surface 78 since already orienting the actuator 16 to establish the reliable connection facilitates a controlled parallel orientation of the actuator 16 relative to the housing section surface 80 and the individual grooves 36 are not covered by the manually or machine grippable handle. The assembly handle 76 is configured gap free with the carrier element 30 and configured perpendicular to the extension of the connection socket 26.

Furthermore a hexagonal actuation element 82 is configured centrally on the mounting handle 76, this means put differently coaxial with the longitudinal axis 22. The operating element 82 facilitates mounting the actuator 16, advantageously with typical assembly tools like e.g. like wrenches.

What is claimed is:

1. An actuator for a cam phaser, the actuator comprising:
at least one form locking connection,
wherein the cam phaser includes a hydraulic valve that is adjusted by the actuator,
wherein the actuator is received at a housing section of the hydraulic valve by the at least one form locking connection,
wherein the at least one form locking connection includes a first locking element pair and a second locking element pair,
wherein the first locking element pair includes a first locking element and a first stop and the second locking element pair includes a second locking element and a second stop,
wherein the first locking element and the second locking element are each integrally formed in one piece with the actuator,
wherein the first stop and the second stop are each integrally formed in one piece with the housing section,
wherein the first stop and the second stop are configured to stop a rotation of the actuator in opposite directions through a direct contact of the first locking element at the first stop and a direct contact of the second locking element at the second stop,
wherein the second locking element is movable relative to the actuator in a direction parallel to an axis of the rotation to interlock at the second stop or unlock from the second stop, and
wherein the first locking element pair is configured as a bayonet closure and the second locking element pair is configured as a snap locking closure.

2. The actuator according to claim 1, wherein the actuator performs a linear movement and a rotating movement to engage the at least one form locking connection or to disengage the at least one form locking connection.

3. The actuator according to claim 2, wherein the actuator is configured to engage the at least one form locking connection or to disengage the at least one form locking connection by initially performing the linear movement and subsequently performing the rotating movement.

4. The actuator according to claim 1, wherein interlocking the second form element at the second stop is directly caused by interlocking the first form element at the first stop.

5. The actuator according to claim 1, wherein the first locking element pair is configured completely rigid and the second locking element pair is configured at least partially elastic.

6. The actuator according to claim 1, wherein the housing section is a section of a cylinder head of an internal combustion engine.

7. The actuator according to claim 1, further comprising an assembly handle.

8. The actuator according to claim 7, wherein the assembly handle is configured as a bar that extends transversal to the axis of rotation over a carrier element configured on the actuator adjacent to the assembly handle.

9. The actuator according to claim 1, wherein the actuator is made from injection molded plastic material.

10. A cam phaser, comprising: the actuator according to claim 1.

11. An actuator for a cam phaser, the actuator comprising:
at least one form locking connection,
wherein the cam phaser includes a hydraulic valve that is adjusted by the actuator,
wherein the actuator is received at a housing section of the hydraulic valve by the at least one form locking connection,
wherein the at least one form locking connection includes a first locking element pair and a second locking element pair,
wherein the first locking element pair includes a first stop and the second locking element pair includes a second stop,
wherein the first stop and the second stop are configured to stop a rotation of the actuator in opposite directions,
wherein the actuator includes an assembly handle, and
wherein the assembly handle is configured perpendicular to a connection socket of the actuator.

12. An actuator for a cam phaser, the actuator comprising:
at least one form locking connection,
wherein the cam phaser includes a hydraulic valve that is adjusted by the actuator,
wherein the actuator is received at a housing section of the hydraulic valve by the at least one form locking connection,
wherein the at least one form locking connection includes a first locking element pair and a second locking element pair,
wherein the first locking element pair includes a first stop and the second locking element pair includes a second stop, and
wherein the first stop and the second stop are configured to stop a rotation of the actuator in opposite directions,
wherein the actuator includes an assembly handle, and
wherein the assembly handle is configured gap free with a carrier element configured on the actuator adjacent to the assembly handle.

* * * * *